US006612268B1

(12) United States Patent
Peteri et al.

(10) Patent No.: US 6,612,268 B1
(45) Date of Patent: Sep. 2, 2003

(54) HOT-WATER APPLIANCE WITH VACUUM INSULATION, TO BE CONNECTED TO THE WATER MAIN

(76) Inventors: Henri Bernard Peteri, Rozenburglaan 31, Rotterdam 3062 EB (NL); Niels Theodoor Peteri, 1s-Gravenweg 27, Rotterdam 3062 ZA (NL)

( * ) Notice: Subject to any disclaimer, the term of this patent is extended or adjusted under 35 U.S.C. 154(b) by 0 days.

(21) Appl. No.: 09/959,021

(22) PCT Filed: Apr. 18, 2000

(86) PCT No.: PCT/NL00/00250

§ 371 (c)(1),
(2), (4) Date: Jan. 29, 2002

(87) PCT Pub. No.: WO00/63623

PCT Pub. Date: Oct. 26, 2000

(30) Foreign Application Priority Data

Apr. 19, 1999 (NL) ..... 1011826

(51) Int. Cl.[7] ..... F22B 15/02
(52) U.S. Cl. ..... 122/19.2; 392/441; 392/451
(58) Field of Search ..... 122/13.01, 19.2, 122/494; 220/567.3, 495.01, 694.1; 392/441, 451; 126/350.2

(56) References Cited

U.S. PATENT DOCUMENTS 3,830,288 A 8/1974 Laing
4,313,400 A * 2/1982 Walker et al. ..... 122/15.1
4,865,014 A * 9/1989 Nelson ..... 122/19.2
4,974,551 A 12/1990 Nelson
5,006,689 A * 4/1991 Kurachi et al. ..... 122/13.01

FOREIGN PATENT DOCUMENTS

EP 0 309 198 3/1989
WO WO 85/01790 4/1985

* cited by examiner

*Primary Examiner*—Gregory Wilson
(74) *Attorney, Agent, or Firm*—Anderson Kill & Olick, P.C.; Eugene Lieberstein; Michael N. Meller

(57) ABSTRACT

A hot-water appliance capable of resisting at least the pressure of the public water supply system, comprising at least one hot-water vessel with a supply conduit connectable to the public water supply system and a discharge conduit connectable to a draw-off tap, wherein the hot-water vessel further comprises a substantially cylindrical jacket wall and two end walls, characterized in that a vacuum insulated jacket (2) surrounds at least the cylindrical wall part (1*a,* 9) of the hot water vessel, with said vacuum insulated jacket consisting of wall(s) composed of a solid non-plastic material composition and a thickness of less than ca. 2 cm, the wall(s) enclosing a hollow vacuum space whereupon at a temperature difference between the hot water vessel and the ambient atmosphere of at least 90° C. the vacuum insulated jacket will retain an internal absolute pressure in the vacuum space of less than $10^{-2}$ millibar, corresponding to a vacuum of less than 0.0075 torr, such that the heat loss per unit area of surface area to be insulated is not more than 200 watts per square meter.

33 Claims, 5 Drawing Sheets

FIGURE 2 (A-A)

HOT-WATER APPLIANCE WITH VACUUM INSULATION, TO BE CONNECTED TO THE WATER MAIN

FIELD OF THE INVENTION

The invention relates to a hot-water appliance capable of resisting at least the pressure of the public water supply system, comprising at least one hot-water vessel with a supply conduit connectable to the public water supply system and a discharge conduit connectable to a draw-off tap. The hot-water vessel further comprises a heating element contained in the hot-water vessel, temperature regulation and a substantially cylindrical outer jacket wall and preferably with two end walls.

BACKGROUND OF THE INVENTION

Such a device, which, in that case, is intended to supply water of substantially 100° C., is known from British patent No. 1,373,990. The known device is provided with a plastic foam heat insulation. A drawback, more and more felt in the last few years from environmental considerations, of this type of frequently used devices having a hot-water vessel as buffer reservoir, which is often continuously maintained at higher temperatures, is the heat loss. This is particularly true of devices intended to frequently and immediately supply small amounts of hot water. The solution for the heat loss has hitherto been sought in the improvement of the insulating material and the use of a greater layer thickness. Both approaching methods give insufficient results for small hot-water appliances of at most 20 liters capacity, which are intended for heating temperatures above at least 80° C. In practice, it has been found hardly possible to obtain affordable, much better insulating properties than, for instance, those of a high-quality polyurethane foam, for which, from considerations of energy saving, a layer thickness of 4 cm is advisable. The use of this greater layer thickness of the insulating jacket, however, does not lead to the desired result, because devices for immediately supplying small amounts of hot or boiling water require that the heating vessel is placed as close to the draw-off point as possible to prevent time loss, water loss, and energy loss owing to cold lead through cooling of the intermediate pipe between the draw-off point and the heating vessel. Close to the draw-off point, such as, for instance, in the kitchen of a household in the kitchen cabinet under the draining board close to the sink, much too little space is usually present, however, to enable the arrangement of a hot-water appliance having a sufficiently thick insulating jacket. It is therefore highly important that the outside dimensions of a heating appliance for this kind of applications are as small as possible. The arrangement of a hot-water appliance under a washbasin, close to the warm-water tap, also urgently requires a smallest possible dimension, while retaining a sufficient water capacity of sufficiently high temperature, to open up a large market segment of energy saving.

The total insulating layer of a small cylindrical hot-water vessel of less than 20 liters capacity occupies much space when compared to the water volume. Take, for instance, a small upright cylindrical reservoir having a height/diameter ration of 2/1, then of a diameter of 12.4 cm the capacity is 3 liters. When this cylinder is covered at the side wall and at the end faces with an insulating layer thickness of only 3 cm, the total capacity is already more than 8 liters. In this case an insulating volume of more than 5 liters is required to insulate 3 liters with an insulating thickness which, from environmental considerations, should actually be more than 4 cm for appliances that are switched on day and night. This is all the more true of the use of the pertinent type of hot-water appliances in air-conditioned spaces.

European patent application EP-A-0 309 198 describes a hot-water device comprising a hot-water vessel, which hot-water vessel is insulated by means of a vacuum insulating jacket. The publication, however, very clearly described that in such a device it is undesirable that the heating means are contained in the tank, because this considerably increases the production cost of the device in connection with the opening which has to be present in the vacuum insulating jacket. Moreover, this publication states that through the heating by means of a heating element arranged in the vessel a mixing of cold water with added warm water and warm water already present in the tank occurs, so that it is impossible after drawing off an amount of hot water to immediately provide hot water of a desired temperature. The European publication therefore proposes to arrange the heating element outside the tank and to design it as an instantaneous heating element. A drawback of this solution is of course that the heat loss occurs at the instantaneous heating element, because this instantaneous heating element is not insulated. If such an instantaneous heating element is to be insulated, this would be done by means of insulating foam, which, in turn, would lead to undesirable large dimensions. Moreover, the heating coil has a much higher temperature than the liquid, which substantially complicates the selection of the insulating materials. In the device according to the present invention this problem has been solved by still arranging the heating elements in the tank, in spite of the attendant problems, and insulating, with another form of insulation, only the opening in the vacuum insulating jacket through which the heating means still extend into the tank.

WO A 85/01790 relates to a solar boiler comprising a vacuum insulating jacket. This publication does not teach a person skilled in the art anything more than that insulation can be effected with a vacuum insulating jacket. Furthermore, the publication is not relevant to the present invention, since it does not disclose the arrangement of a heating element in the hot-water vessel. Moreover, the known device is not provided with a temperature regulation, and the tank is not of cylindrical, but of spherical design. It is not clear how the transparent spherical shell halves of the outside jacket in the known device can be connected together such that a vacuum can be created therein which is maintained for a longer period. Moreover, no indication whatever can be derived from the publication for the height of the vacuum. The information that the vacuum is almost 100% is meaningless to a person of average skill in the art. The connection between the inside tank and the outside shell at the location of the passage of the conduits is not further explained either and forms a position susceptible to leakage.

The American patent U.S. Pat. No. 4,974,551 relates to a water heater made of plastic. It is true that it is described therein that the container is insulated by means of a vacuum insulating jacket, but, in practice, plastic is absolutely unsuitable for the performance of a sealing function. Moreover, in the course of time, plastic itself releases a large number of gases which remove the vacuum in the jacket. Therefore, in this known device the vacuum required for insulation is absolutely not present. The publication therefore proposes to insulate the jacket with insulating material, such as glass wool or urethane foam. In the device known from the American patent a vacuum of ca. 10–2 mb, as proposed in a further elaboration of the present invention, is absolutely impractical.

U.S. Pat. No. 3,830,288 relates to an insulating jacket for a heat storing device which is heated with inexpensive current, and which, during the day, releases its heat to the space in which it is arranged. Preferably, these heat storing devices are located below the window and are therefore of flat and rectangular design. This publication therefore does not relate to a hot-water appliance comprising a hot-water vessel with a supply conduit which is connectable to the public water supply system and a discharge conduit which is connectable to a draw-off tap. Moreover, the insulating jacket described in this publication is filed with gas. This is contradictory to the proposal according to the invention in which a high vacuum is proposed for the insulation of the hot-water vessel.

Non of the above-discussed publications therefore discloses a hot-water appliance comprising a vacuum insulating jacket. Even less do these publications disclose a hot-water appliance the insulating jacket of which is of such design that the heat loss per unit area of surface area to be insulated is not more than 200 watts per $m^2$ at a temperature difference between the inner space enclosed by the insulating jacket and the ambient space of at least 90° C. and at a thickness of the insulating jacket of at most ca. 2 cm. Such a degree of insulation can, as described above, be obtained according to a further elaboration of the invention, because the pressure in the insulating jacket being under a vacuum is less than 10–2 millibar.

SUMMARY OF THE INVENTION

The invention relates to a compact hot-water appliance with a very high degree of insulation characterized in that at least the cylindrical wall part of the hot-water vessel is insulated with a vacuum insulating jacket.

When using a vacuum insulating jacket which covers at least the cylindrical jacket wall of the hot-water vessel, it has been found possible to use insulating wall thicknesses of, for instance, 1 cm or even thinner, with better insulating properties than 4 cm thick polyurethane foam. When a thick conventional insulating layer is used for one or even for both end faces of the cylinder, it is surprising to see how much smaller external volume of the total heating reservoir can be obtained and how strongly the heat losses can be reduced in practice, even when using water temperatures above 100° C., by at least insulating the cylindrical wall part of the hot-water vessel with a vacuum insulating jacket. It is preferred here if, according to a further elaboration of the invention, the insulating jacket is of such design that the heat loss per unit area of surface area to be insulated is not more than 200 watts per square meters at a temperature difference between the inner space enclosed by the insulating jacket and the ambient space of at least 90° C. and at a thickness of the insulating jacket of not more than ca. 2 cm.

To reach such an insulating value with a vacuum insulating jacket having a thickness of at most 2 cm and preferably ca. 1 cm, a high vacuum with an internal pressure less than ca. $10^{-1}$ millibar, preferably ca. $10^{-3}$ millibar or even less, is advisable.

According to a further elaboration of the invention, it is very favorable if the cylindrical wall part of the hot-water vessel is insulated with a vacuum insulating jacket, the inner and outer walls of which are connected together at the location of at least one connecting edge, which connecting edge is situated at a distance from the water in the hot-water vessel which is greater than the distance between the inner and outer walls at the location of the hot-water vessel, while the distance between the connecting edge and the hot-water vessel is bridged by an insulating jacket wall part. The effect thus obtained is that the insulating jacket wall part forms a heat bridge between the hot-water vessel being at high temperature and the outer wall of the vacuum insulating jacket being at ambient temperature. The heat resistance of this heat bridge can be increased by increasing the height of the insulating jacket wall part, by reducing the material thickness of the insulating jacket wall part and by selecting a material for the insulating jacket wall part having a low heat conductivity. Thus the unavoidable heat losses as a result of conduction can be strongly reduced.

Furthermore, it is very favorable if the or each connecting edge defines an opening in the insulating jacket which gives access to the hot-water vessel. Thus the exchange of, for instance, heating elements and the removal of scale become possible, while, moreover, if desired, a passage is provided for inlet and outlet openings.

To limit as much as possible the wall part of the hot-water vessel not insulated by the vacuum insulating jacket, it is very favorable if the height/diameter ratio of the hot-water vessel is at least 1.5/1.

BRIEF DESCRIPTION OF THE DRAWINGS

Further elaborations of the invention will be described and will be explained hereafter with reference to the accompanying drawings

DETAILED DESCRIPTION OF THE INVENTION

Figure 1:
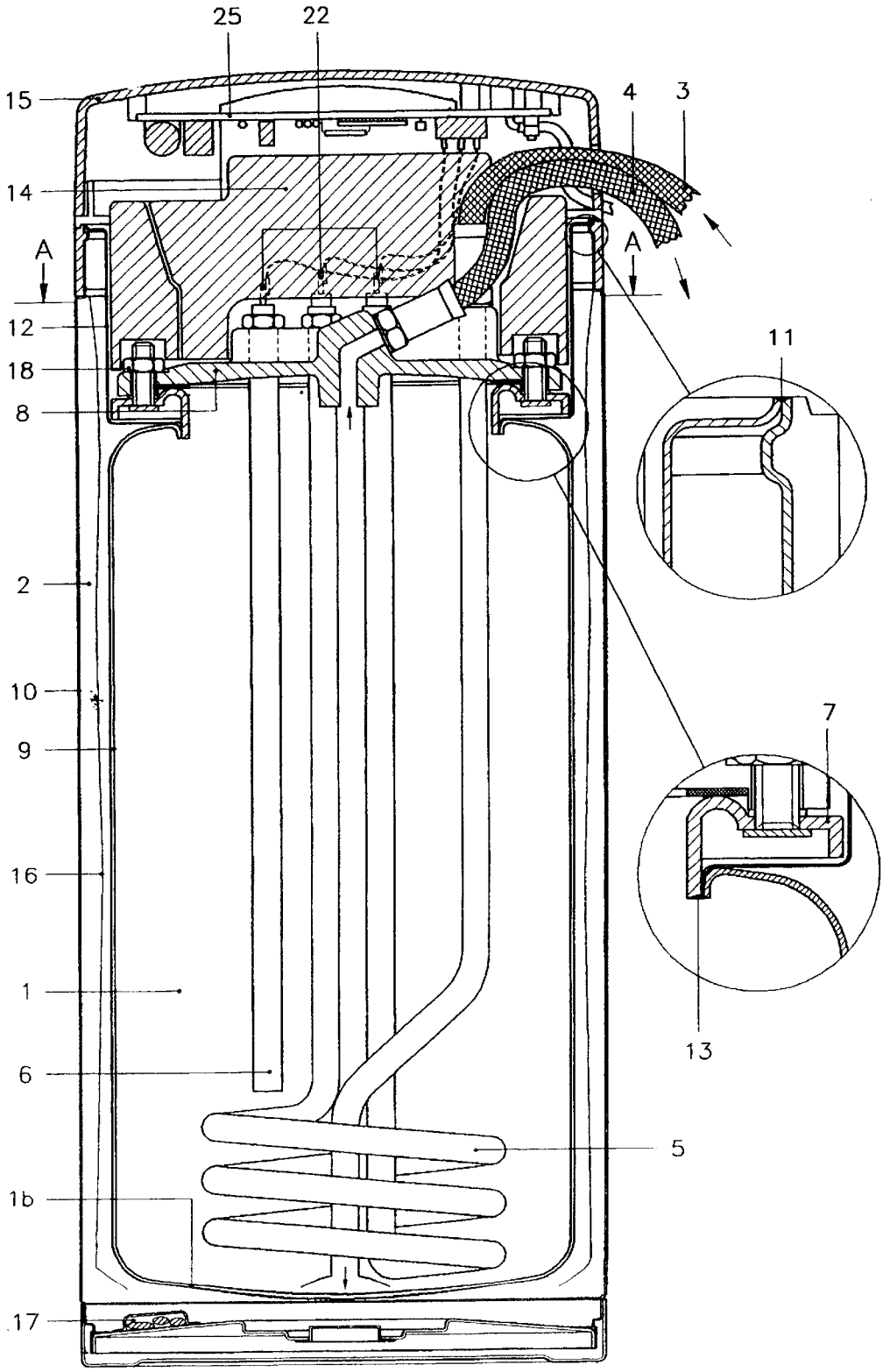
FIG. 1 is a longitudinal section of a hot-water appliance with vacuum insulation, in which the wall of the hot-water vessel largely consists of the inner wall of the vacuum insulating jacket.

FIG. 1 shows a hot-water appliance in which both the cylindrical wall part 9 and the bottom 1*b* of the hot-water vessel 1 are insulated by a vacuum insulating jacket 2. The hot-water vessel 1 can be connected via a supply conduit 3 to the water main and via the discharge conduit 4 to a draw-off tap. Furthermore, the hot-water appliance 1 comprises a heating element 5 and a temperature sensor 6 having an electronic temperature regulation 25, with which the water temperature is thermostatically regulated. Arranged at the upper end of the hot-water vessel 1 is a flange 7, on which a cover 8 fits, so that the hot-water vessel 1 can be closed by means of bolts 18. By removing the cover 8 the temperature sensor 6, the heating element 5, and the water connections 3, 4 can be removed as well.

The vacuum insulating jacket 2 is defined by an inner wall 9 being at elevated temperature and an outer wall 10 being at ambient temperature. In this practical example, the inner wall 9 also serves as wall of the hot-water vessel 1.

At the upper end of the insulating jacket 2 the inner and the outer wall 9 and 10, respectively, are connected together with a, for instance welded or soldered, annular connecting edge 11. This connecting edge 11, which leaves clear an opening which is large enough to remove the cover 8 from the hot-water vessel 1, is situated at a wide distance, such as, for instance, 5 cm from the wall 9, which is in contact with the hot water of the hot-water vessel 1.

In this example, the upper part of the inner wall 9 of the insulating jacket 2 is formed by the insulating jacket wall part 12, which is situated between the connecting edge 11 and a connecting edge 13, where the upper end of the heating vessel 1 is connected with the flange 7 and also with the lower end of the insulating jacket wall part 12. This insulating jacket wall part 12, which is made of thin-walled, poorly heat-conducting metal, such as, for instance, some types of stainless steel, forms the heat loss-limiting heat bridge between the high temperature of the hot-water vessel 1 and the outer wall 10 being at approximately room temperature.

Together with the cover 8 of the hot-water vessel 1, the pertinent insulating jacket wall part 12 forms a cup-shaped space above the cover 8, which space can be filled with conventional insulating material 14, such as, for instance, plastic foam.

The drawing shows a pair of blocks of insulating foam 14, which closely abut the wall and fit together, and with which the upper end of the hot-water vessel 1 is insulated. The effect thus achieved is that the slight heat losses owing to the insulating jacket wall part 12 serving as heat bridge remain almost completely limited to the losses of heat conduction because losses through radiation at the heat bridge are almost completely screened by the insulating material 14.

In the insulating material 14 a space is left to allow the passage of the connections for the current supply 22 to the heating element 5 and to the thermostat sensor 6 and of the water supply and discharge conduits 3, 4.

The strength of the outer wall 10 of the insulating jacket 2 must be sufficient to serve as attachment of the filled hot-water vessel 1 to prevent damage from the outside and to resist the internal vacuum. To this end, sheet steel of ca. 0.4–1.0 mm can be used, depending on the water capacity. For the hot-water vessel corrosion-resistant chrome nickel steel having a thickness of ca. 0.2–0.4 mm can be used.

The height and thickness of the insulating jacket wall part 12 is important to limit the losses of heat conduction. It is very advantageous that the insulating jacket wall part 12 is not susceptible to corrosion by contact with water and is almost completely under strain of tension under the influence of the vacuum in the insulating jacket. For this reason it can be made of thin stainless sheet steel having a heat conductivity of, for instance, 10 watts/° C. up to a thickness of even 02. mm. As long as the strength is sufficient to resist the pressure of the vacuum and the weight of the hot-water vessel 1, it will not be exposed to deformation, partly as a result of the vacuum.

Fitting on the connecting edge 11 of the insulating jacket 12, a closing cap 15 is shown, on the inner side of which the electronics for the temperature regulation is provided.

Inside the vacuum of the insulating jacket 2, the drawing further shows a radiation screen 16 consisting of thin reflecting foil to inhibit losses of radiation through the vacuum wall.

Figure 2:
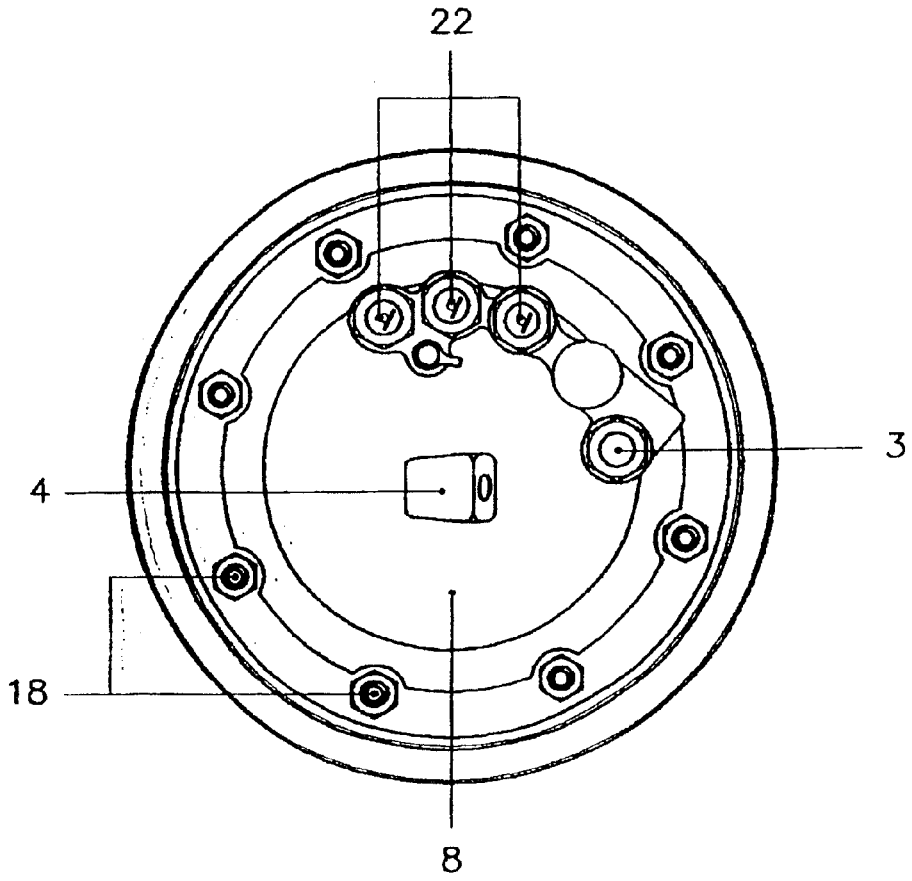
FIG. 2 is a cross-sectional view taken on the line A—A of FIG. 1.

Finally, inside the insulating jacket 2 is shown a holder for getter material 17 to maintain the high vacuum for years FIG. 2 shows the top view of the section A—A of FIG. 1 after removal of the upper cap 15, the insulating material 14, the water hoses 3 and 4, and the electric connections, so that the upper side of the cover 8 of the hot-water vessel 1, which is fastened with the nuts 18, can be seen.

In the construction shown in FIGS. 1 and 2, the hot-water appliance can be easily disassembled into a small number of parts, which is an advantage during the maintenance. The closing cap 15, in which the electronics is contained, can be removed separately, after the plug connections to the heating element and the temperature sensor have been uncoupled. Subsequently, the blocks of insulating foam 14 can be removed. Then the cover 8 can be removed from the hot-water vessel 1 after removal of the nuts 18. The inlet and outlet conduits 3, 4 attached to the cover 8, the temperature sensor 6, and the heating element 5 can be taken from the hot-water vessel 1 together with the cover 8 and can be disassembled separately.

This disassembly is of course also advantageous, if the parts of the appliance have to be recycled at the end of their life. The insulating jacket wall 2 with the flange 7 and the insulating jacket wall part 12 may fully consist of stainless steel. The cover 8, from which the through parts can be uncoupled may consist of a separately recyclable bronze alloy. The plastic closing cap 15 with the electronics and the blocks of insulating foam 14 have to be recycled separately.

In FIG. 1 the cylindrical outer wall 10 is kept flat. Especially in a somewhat larger hot-water appliance it may be advantageous, for the sake of strength or from esthetic considerations, to provide one or more grooves or corrugations. It may also be advisable to increase the capacity of the hot-water vessel 1 by making the diameter of the vacuum jacket 2 below the cover 8 larger than the diameter of the insulating jacket wall part 12.

Figure 3:
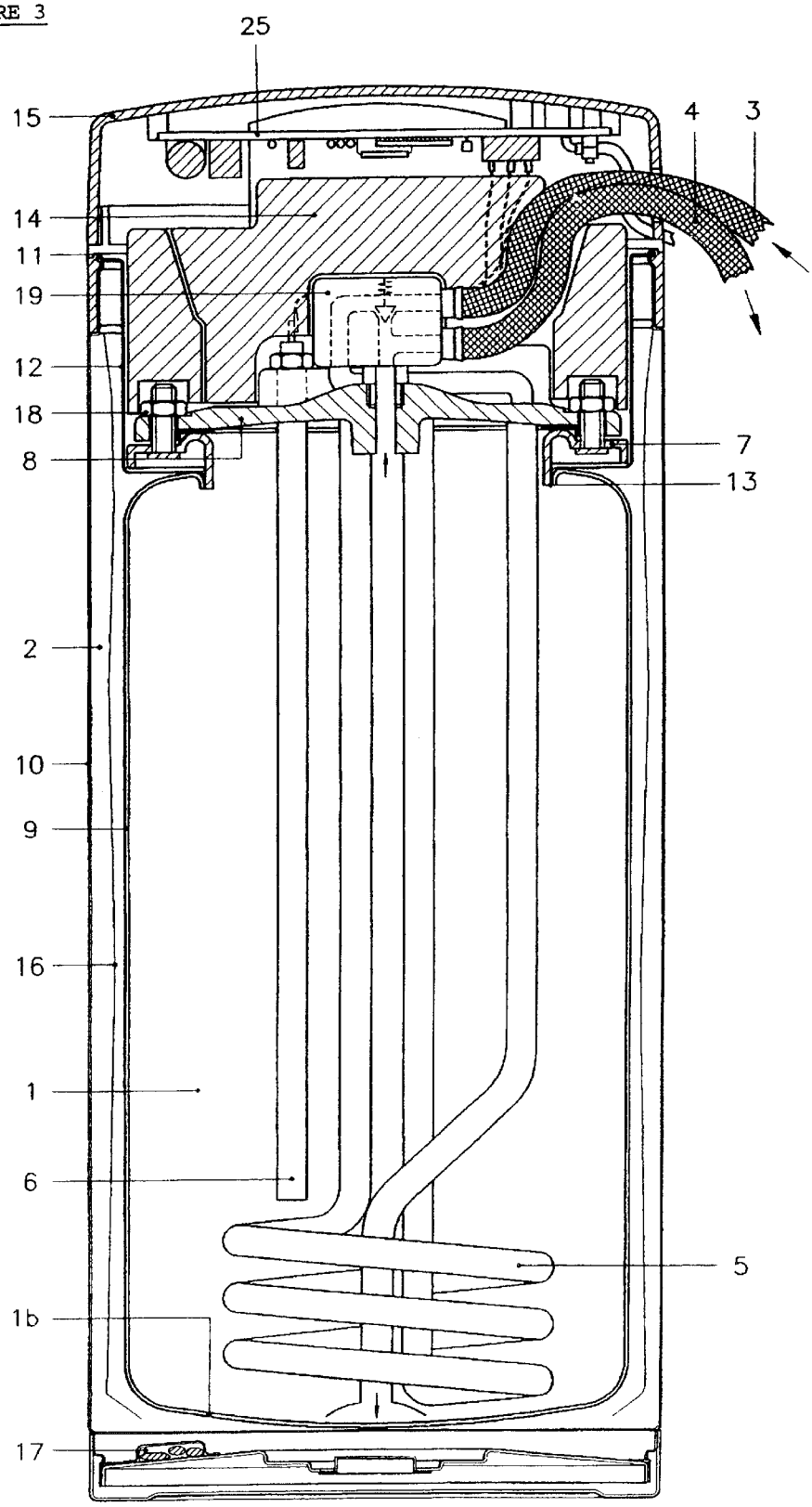
FIG. 3 is a longitudinal section of a hot-water appliance with vacuum insulation, in which a mixing device for hot and cold water is arranged at the upper end.

FIG. 3 is a longitudinal section of a hot-water appliance with vacuum insulating jacket 2, in which a mixing device 19 for hot and cold water is arranged, so that the draw-off point is fed with warm water of lower temperature than the high temperature of the water in the hot-water vessel 1. The effect obtained by this use of the invention is that a hot-water appliance with a slight heat loss, which, owing to the small outside dimension, can be placed close to the draw-off point, can supply a much larger amount of water than the capacity of the hot-water vessel 1. Here the water in the hot-water vessel is kept at a temperature of ca. 100° C., while the outflowing water may have any temperature by mixing with the cold water.

Figure 4:
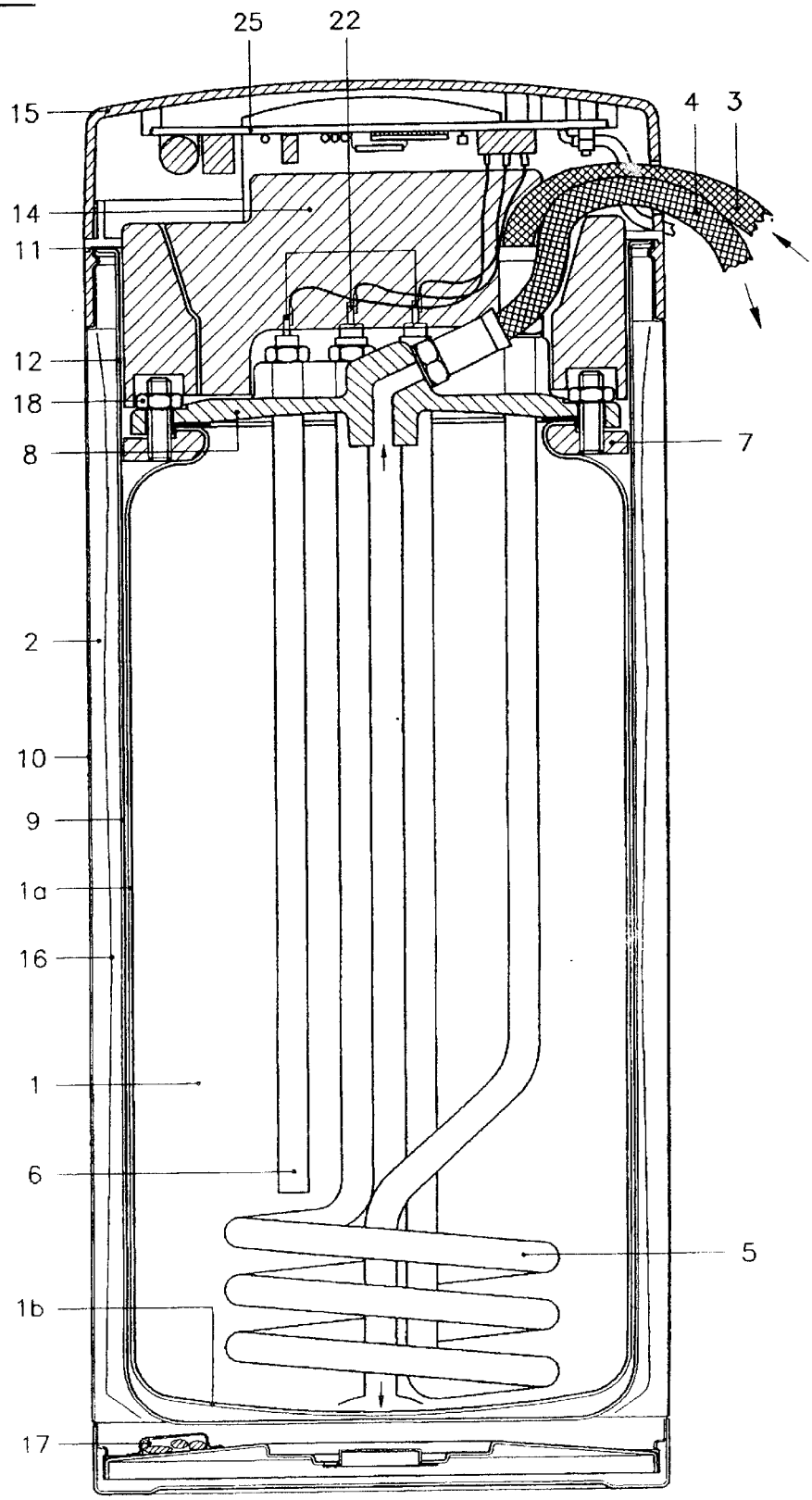
FIG. 4 is a longitudinal section of a hot-water appliance with vacuum insulation, in which a separate hot-water vessel is slid into a bucket-shaped vacuum insulating jacket.

FIG. 4 is a cross-section of a hot-water appliance, in which the hot-water vessel 1 and the vacuum insulating jacket 2 are separate parts, which may be made of different materials. Here the hot-water vessel 1 comprising a cylindrical jacket wall 1*a* and a bottom wall 1*b*, as well as a cover 8 and further accessories, is slid from above into the bucket-shaped insulating jacket 2. The vacuum insulating jacket 2 comprises an inner wall 9 and an outer wall 10. The insulating jacket wall part 12, also shown in FIG. 1, which functions as heat bridge, is formed here by the upper end of the inner wall 9 of the insulating jacket 2 between the annular connecting edge 11 and an annular area limit 20 at the same level as the upper side of the cover 8, which forms the bottom of the cup-shaped space largely filled with insulating material 14.

Figure 5:
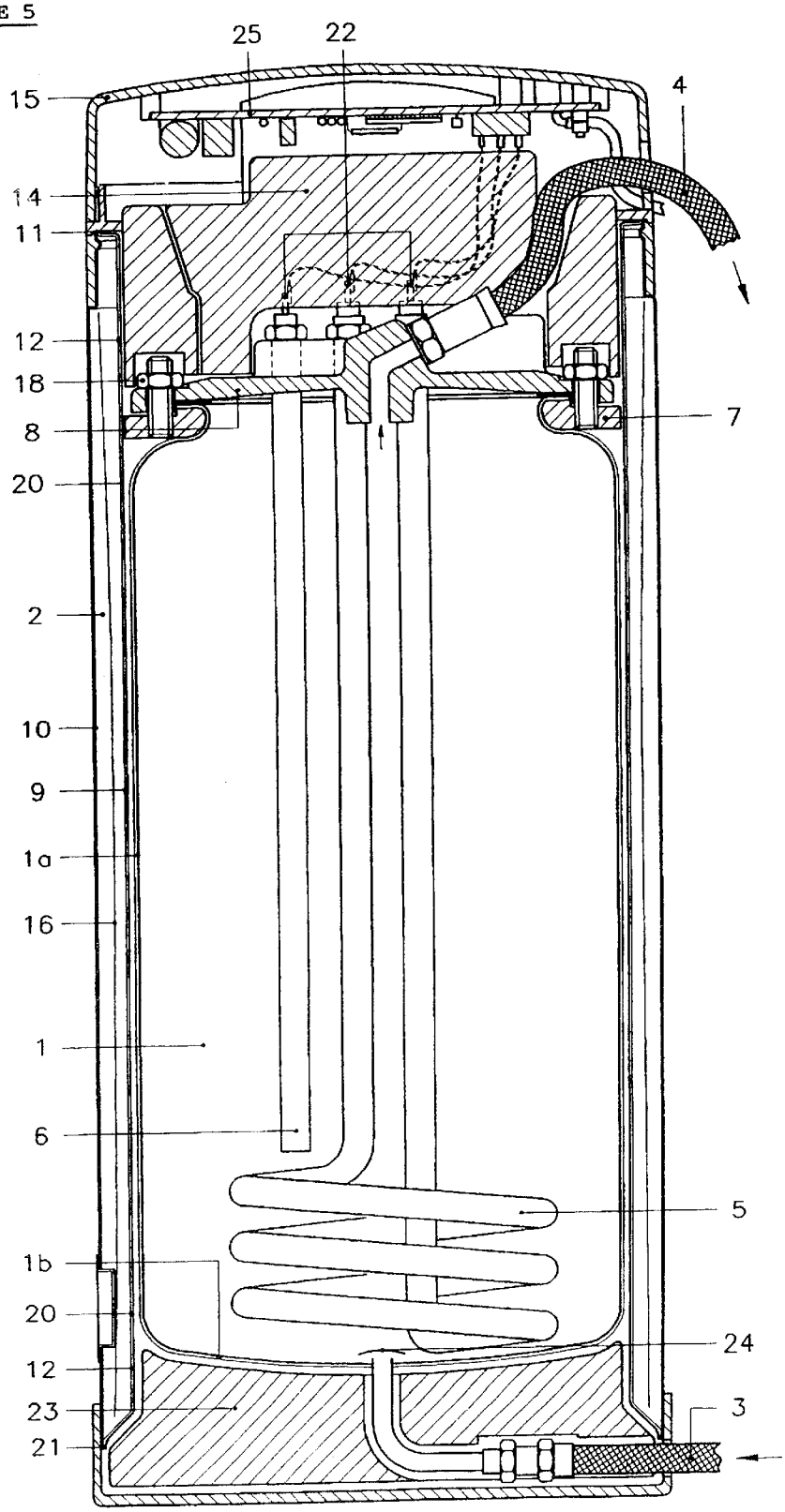
FIG. 5 is a section of a hot-water appliance, in which the inner and outer walls of the insulating jacket are connected with a connecting edge both at the upper and at the lower end.

FIG. 5 is a cross-section of a hot-water appliance in which, like in FIG. 4, the hot-water vessel 1 and the vacuum insulating jacket 2 are separate parts, which can be slid into each other. In this case the insulating jacket 2 consists of an inner wall 9 and an outer wall 10, which are connected together with an annular connecting edge 11 and 21, both at the upper end and at the lower end. Thus a cup-shaped space is formed at both ends, which are each filled with a conventional insulating material 14, 23. In the practical example shown in FIG. 5, the water supply conduit 3 opens into the lower end of the hot-water vessel 1. To ensure that the cold water supplied via conduit 3 does not mix with the hot water contained at the top of the hot-water vessel 1, a screening cap 24 laterally deflecting the inflowing water is placed above the outflow opening of the conduit 3.

It may be clear that the invention is not limited to the described practical examples, but that various modifications are possible within the scope of the invention. Thus, to increase the available volume, the hot-water appliance may comprise a plurality of hot-water vessels 1, which are each provided with their own vacuum insulating jacket. In this modification, the vessels may be series-connected, and the supply conduit 3 is connected to a first vessel, while the supply conduit 4 is connected to a last vessel in the series. It is self-explanatory that in such a series connection of hot-water vessels only the first vessel needs to be provided with a heating element 5 of high capacity, while the downstream hot-water vessels only need to be provided with a heating element having a capacity sufficient to maintain the hot water contained in those vessels at the required temperature.

What is claimed is:

1. A hot-water appliance capable of resisting pressure in the public water supply system, comprising at least one hot-water vessel (1) with a supply conduit (3) connectable to the public water supply system and a discharge conduit (4) connectable to a draw-off tap, wherein said one hot-water vessel (1) further comprises a heating element (5) contained in the hot-water vessel (1) and a temperature regulation (25), a substantially cylindrical jacket wall **(1*a*, 9) and two end walls (1*b*, 8), with said one hot-water vessel (1) having a maximum capacity of 20 liters for heating water characterized in that a vacuum insulated jacket (2) surrounds at least the cylindrical wall part (1*a*, 9)** of the hot water vessel, with said vacuum insulated jacket consisting of wall(s) composed of a solid non-plastic material composition and a thickness of less than ca. 2 cm, the wall(s) enclosing a hollow vacuum space whereupon at a temperature difference between the hot water vessel and the ambient atmosphere of at least 90° C. the vacuum insulated jacket will retain an internal absolute pressure in the vacuum space of less than $10^{-2}$ millibar, corresponding to a vacuum of less than 0.0075 torr, such that the heat loss per unit area of surface area to be insulated is not more than 200 watts per square meter.

2. A hot-water appliance according to claim 1, characterized in that the height/diameter ratio of the hot-water vessel (1) is at least 1.5/1.

3. A hot-water appliance according to claim 1, characterized in that the vacuum insulating jacket (2) comprises an inner wall (9) and an outer wall (10), which inner wall (9) and outer wall (10) are connected together at the location of at least one connecting edge (11, 21), which connecting edge (11, 21) is situated at a distance from the water in the hot-water vessel (1) which is greater than the distance between the inner and outer walls (9 and 10, respectively) at the location of the hot-water vessel (1), while the distance between the connecting edge (11, 21) and the hot-water vessel (1) is bridged by an insulating jacket wall part (12).

4. A hot-water appliance according to claim 3, characterized in that said one connecting edge (11, 21) defines an opening in the insulating jacket (2) which gives access to an end wall **(1*b*, 8) of the hot-water vessel (1)**.

5. A hot-water appliance according to claim 4, characterized in that a substantially cup-shaped space is formed by said opening in the insulating jacket (2), while an insulating jacket wall part (12) defines a side limit of the cup-shaped space, and an end wall **(1*b*, 8) of the hot-water vessel defines a bottom limit of said cup-shaped space, with said cup-shaped space being at least partly filled with insulating material (14, 23)**.

6. A hot-water appliance according to claim 3, characterized in that the said insulating jacket wall part (12) is made of material having a relatively low heat conduction coefficient.

7. A hot-water appliance according to claim 6, characterized in that the insulating jacket wall part (12) is made of stainless steel.

8. A hot-water appliance according to claim 3, characterized in that the insulating jacket wall part (12) is thin-walled.

9. A hot-water appliance according to claim 3, characterized in that the distance between the connecting edge (11, 21) and the hot-water vessel (1) is at least 5 cm at a hot-water vessel capacity of 3–7 liters.

10. A hot-water appliance according to claim 3, characterized in that the hot-water vessel (1) comprises a water-tightly sealing detachable cover (8) which seals an opening in the hot-water vessel (1) through which the heating element (5) is removable, while the opening in the insulating jacket (2) is of a size such that the cover (8) of the hot-water vessel (1) is removable via the opening in the insulating jacket (2).

11. A hot-water appliance according to claim 10 characterized by an evacuated space in the insulating jacket which contains at least one layer of a reflecting foil (16).

12. A hot-water appliance according to claim 3, characterized in that the inner wall (9) of the insulating jacket (2) also forms at least the cylindrical jacket wall of the hot-water vessel (1).

13. A heat-insulated hot-water appliance according to claim 12, characterized in that the inner wall of the vacuum insulating jacket (2) also forms an end wall **(1*b*) of the hot-water vessel (1), which vacuum insulating jacket (2) also insulates the pertinent end wall (1*b*)**.

14. A hot-water appliance according to claim 12, characterized in that the hot-water vessel (1) and the insulating jacket (2) are separate parts, which hot-water vessel (1) is slidably arranged in the insulating jacket (2).

15. A hot-water appliance according to claim 12, characterized in that the insulating jacket (2) is designed as a double-wall cylindrical element, the outer wall (10) and the inner wall (9) of which are connected together at the leading ends, which two leading ends each define a cup-shaped space, which cup-shaped spaces contain insulating material (14, 23).

16. A hot-water appliance according to claim 12, characterized in that the insulating jacket (2) is designed as a double-walled cylindrical element, the outer wall (10) and the inner wall (9) of which are connected together at the leading ends, which two leading ends each define a cup-shaped space, which cup-shaped spaces contain insulating material (14, 23).

17. A hot-water appliance according to claim 12, characterized in that the outer wall (10) is made of sheet steel having a thickness of about 0.4–1.0 mm, and the inner wall (9) is made of chrome nickel steel having a thickness of 0.2–0.4 mm.

18. A hot-water appliance according to claim 12, characterized in that a mixing device (19) is provided which is arranged to mix hot water originating from the hot-water vessel (1) and cold water originating from the public water supply system.

19. A hot-water appliance according to claim 3, characterized in that the insulating jacket (2) is designed as a double-walled cylindrical element, the outer wall (10) and the inner wall (9) of which are connected together at the leading ends, which two leading ends each define a cup-shaped space, which cup-shaped spaces contain insulating material (14, 23).

20. A hot-water appliance according to claim 19 characterized by an evacuated space in the insulating jacket which contains at least one layer of a reflecting foil (16).

21. A hot-water appliance according to claim 3, characterized in that the outer wall (10) is made of sheet steel having a thickness of about 0.4–1.0 mm, and the inner wall (9) is made of chrome nickel steel having a thickness of 0.2–0.4 mm.

22. A hot-water appliance according to claim 3, characterized in that the hot-water vessel (1) and the insulating jacket (2) are separate parts, which hot-water vessel (1) is slidable arranged in the insulating jacket (2).

23. A heat-insulated hot-water appliance according to claim 3, characterized in that the outer wall (10) is sufficiently strong to resist the atmospheric pressure and to prevent damage during use, and the inner wall (9) is made of a thin metal sheet part having a low heat and conductivity.

24. A hot-water appliance according to claim 3 characterized in that the temperature regulation (25) is adjustable to maintain a temperature of more than 100° C. in the hot-water vessel (1).

25. A hot-water appliance according to claim 3 characterized by an evacuated space in the insulating jacket which contains at least one layer of a reflecting foil (16).

26. A hot-water appliance according to claim 1, characterized in that the hot-water vessel (1) and the insulating jacket (2) are separate parts, which hot-water vessel (1) is slidably arranged in the insulating jacket (2).

27. A hot-water appliance according to claim 26 characterized by an evacuated space in the insulating jacket which contains at least one layer of a reflecting foil (16).

28. A heat-insulated hot-water appliance according to claim 1, characterized in that the outer wall (10) is sufficiently strong to resist the atmospheric pressure and to prevent damage during use, and the inner wall (9) is made of a thin metal sheet part having a low heat and conductivity.

29. A hot-water appliance according to claim 1, characterized in that the temperature regulation (25) is adjustable to maintain a temperature of more than 100° C. in the hot-water vessel (1).

30. A hot-water appliance according to claim 1, characterized by an evacuated space in the insulating jacket which contains at least one layer of a reflecting foil (16).

31. A hot-water appliance according to claim 30, characterized in that in the evacuated space in the insulating jacket (2) a getter (17) to be activated with heat is arranged to improve the vacuum.

32. A hot-water appliance according to claim 1, characterized in that the insulating jacket (10) contains a heat-insulating and radiation-reflecting powder.

33. A hot-water appliance according to claim 1, characterized in that a mixing device (19) is provided which is arranged to mix hot water originating from the hot-water vessel (1) and cold water originating from the public water supply system.

* * * * *

UNITED STATES PATENT AND TRADEMARK OFFICE

CERTIFICATE OF CORRECTION

PATENT NO. : 6,612,268 B1
DATED : September 2, 2003
INVENTOR(S) : Peteri, Henri Bernard It is certified that error appears in the above-identified patent and that said Letters Patent is hereby corrected as shown below:

Column 1,
Line 62, the word “ration” should be -- ratio --
Line 62, the word “of” in the phrase “then of a diameter” should be -- at --

Column 2,
Line 8, the word “described” should be -- describes --

Column 3,
Line 57, the number “ 10 ” should be -- 10 --

Column 4,
Line 27, the word “drawings” should read -- drawings of which --

Column 5,
Line 52, the number “02.” should be -- 0.2 --

Signed and Sealed this

First Day of June, 2004

JON W. DUDAS
*Acting Director of the United States Patent and Trademark Office*